US008379307B2

(12) United States Patent
Thomas et al.

(10) Patent No.: US 8,379,307 B2
(45) Date of Patent: Feb. 19, 2013

(54) DUAL MODE REFLEX AND TELESCOPIC SIGHT COMBINATION

(75) Inventors: Mark A. Thomas, Sisters, OR (US); Mitchell Thomas, Sisters, OR (US); Forrest Babcock, Sisters, OR (US)

(73) Assignee: YT Products, LLC, Sisters, OR (US)

( * ) Notice: Subject to any disclaimer, the term of this patent is extended or adjusted under 35 U.S.C. 154(b) by 164 days.

(21) Appl. No.: 12/626,316

(22) Filed: Nov. 25, 2009

(65) Prior Publication Data

US 2011/0041377 A1 Feb. 24, 2011

Related U.S. Application Data

(60) Provisional application No. 61/274,698, filed on Aug. 20, 2009.

(51) Int. Cl.
*G02B 23/00* (2006.01)

(52) U.S. Cl. ..... 359/429; 359/399; 359/428

(58) Field of Classification Search ..... 359/353, 359/399–429

See application file for complete search history.

(56) References Cited

U.S. PATENT DOCUMENTS

| | | | | |
|---|---|---|---|---|
| 3,992,782 | A | 11/1976 | Rickert | |
| 5,140,151 | A * | 8/1992 | Weiner et al. | 359/226.2 |
| 5,157,548 | A * | 10/1992 | Monnier et al. | 359/630 |
| 5,653,034 | A | 8/1997 | Bindon | |
| 5,815,936 | A | 10/1998 | Sieczka et al. | |
| 5,946,132 | A * | 8/1999 | Phillips | 359/351 |
| 6,169,628 | B1 * | 1/2001 | Isbell et al. | 359/399 |
| 7,409,792 | B2 | 8/2008 | Narcy et al. | |
| 7,552,558 | B1 | 6/2009 | Ballard | |
| 7,869,125 | B2 | 1/2011 | Szapiel et al. | |
| 2005/0132631 | A1 | 6/2005 | Bodo | |
| 2012/0033195 | A1 * | 2/2012 | Tai | 356/4.01 |

FOREIGN PATENT DOCUMENTS

JP 2001-021291 1/2001

OTHER PUBLICATIONS

English abstract of the Japanese reference No. 2001-021291.

* cited by examiner

*Primary Examiner* — Thong Nguyen
(74) *Attorney, Agent, or Firm* — Timothy E Siegel Patent Law, PLLC; Timothy E Siegel

(57) ABSTRACT

A combined reflex/telescopic sight that includes a telescopic optical element train and a view window, offset from the optical element train. A transition assembly is positioned to receive light from the optical element train and the view window and has an image display, a collimating lens-set positioned to transmit light to the image display and a luminous reticle. This assembly may be placed in a first mode wherein light from the optical train travels through the collimating lenses to the image display and light from the view window is blocked. In a second mode light from the optical train is blocked and light from the luminous reticle travels through the collimating lens set and is combined with light from the view window and a resulting combined image appears at the image display. Finally an actuation assembly is adapted to permit a user to switch the transition assembly between modes.

14 Claims, 4 Drawing Sheets

DUAL MODE REFLEX AND TELESCOPIC SIGHT COMBINATION

RELATED APPLICATIONS

This application claims priority from provisional application Ser. No. 61/274,698, filed Aug. 20, 2009, which is hereby incorporated by reference as if fully set forth herein.

BACKGROUND

A reflex or "red dot" sight superimposes a reticle, such as a simple red dot, on a typically unmagnified target. The advantage of a reflex sight is that it is theoretically parallax free, can be held at any distance from the eye, and can be used with both eyes open. Accordingly, the shooter may acquire a target without first carefully placing his eye on an eye-piece, closing the non-aiming eye and finding the target in a limited sight field-of-view. This permits a short range shooter to acquire a target far more rapidly than he could if looking through a telescopic sight.

At longer ranges (e.g. greater than 100 yards) it becomes necessary to use a telescopic sight. Heretofore the problem of installing both a reflex and a telescopic sight on the same gun has not been entirely solved, with suggested solutions sacrificing at least some optical qualities or user convenience.

From a more technical perspective, a reflex sight collimates the light from a luminous reticle and superimposes this light onto a view-window. This places the reticle at an infinite range and virtually eliminates the effects of parallax, when viewing a target that is effectively at an infinite range. Frequently the collimation is performed by a curved mirror that is placed to the side of the path of the light passing through the view-window. Unfortunately, the need to redirect the collimated light reflecting from the curved mirror so that it is superimposed on the view-window complicates the design and tends to reduce performance.

SUMMARY

In a first separate aspect, the present invention may take the form of a combined reflex/telescopic sight that includes a telescopic optical element train and a view window, offset from the optical element train. A transition assembly is positioned to receive light from the optical element train and the view window. The transition assembly has an image display, a collimating lens-set positioned to transmit light to the image display and a luminous reticle. This assembly may be placed in a first mode in which light from the optical train travels through the collimating lens set to the image display and light from the view window is blocked. In a second transition assembly mode light from the optical train is blocked and light from the luminous reticle travels through the collimating lens set and is combined with light from the view window and a resulting combined image appears at the image display. Finally an actuation assembly is adapted to permit a user to switch the transition assembly between the first and second modes.

In a second separate aspect, the present invention may take the form of a telescopic sight that includes a housing defining a centerline, an image output, an optical train, within the housing, causing a reticle to appear to a user looking through the image output. A reticle position adjust mechanism has a reticle position actuator that when manipulated by a user causes the reticle to change position relative to the housing centerline. Finally, a reticle position adjust mechanism lock, having a lock actuator may be placed into either a locked position, in which the reticle position actuator is locked in place or an unlocked position, in which the reticle position actuator may be moved.

In a third separate aspect, the present invention may take the form of a method of switching from a reflex sight to a telescopic that makes use of a combined telescopic and reflex sight. This sight includes a view window, a telescopic optical train, offset from the view window, a collimating lens set and an image display adapted to receive light from the collimating lens set, a luminous reticle and a movable mirror placed in a first position adapted to reflect light from the luminous reticle to the collimating lens set and to block light from the telescopic optical train from entering a light path leading to the image display. The method includes the act of moving the movable mirror from the first position to a second position where it does not reflect light from the luminous reticle but reflects light from the telescopic optical train into a path leading to the image display and blocks light from the view window.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Figure 1:
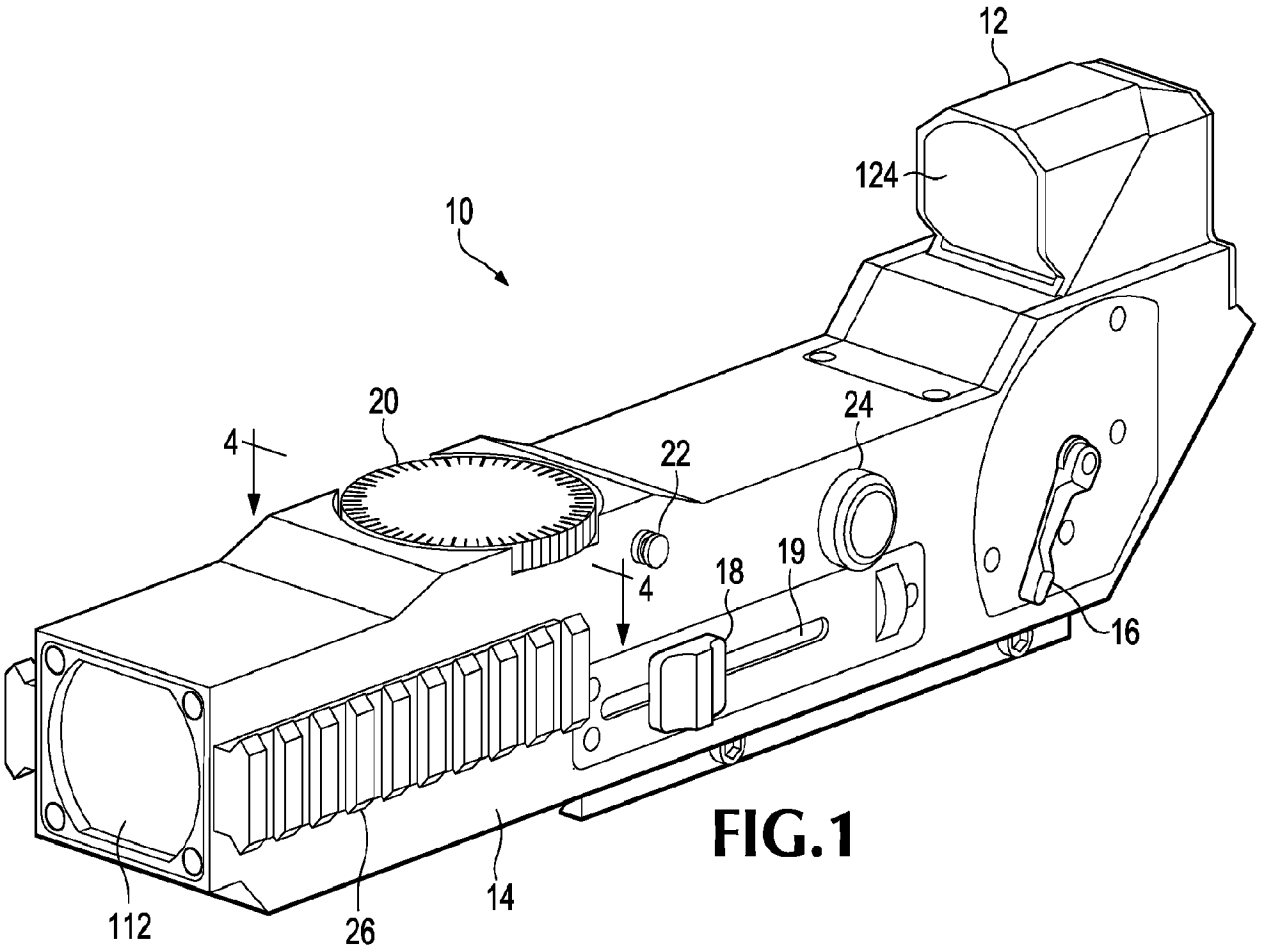
FIG. 1 is a perspective view of a dual mode sight according to the present invention.

Referring to FIG. 1, in a preferred embodiment a dual mode sight 10 includes a reflex portion 12, a telescopic portion 14 and a lever 16, to switch between the use of these two portion 12 and 14. A zoom slider 18 and slider slot 19 permit a user to change sight 10 magnification and an elevation knob 20 permits the reticle position to be changed vertically, to compensate for the anticipated effect of gravity on a fired bullet. A windage knob is hidden from view on the right side of the sight 10 (from the user's perspective), and may be used to change the reticle position horizontally, to compensate for the anticipated effect of wind on a fired bullet. An elevation knob lock 22 can be pushed in to lock the elevation knob in place, to avoid instances in which a piece of vegetation brushes against knob 20 and causes it to move, degrading a previous adjustment. A windage knob lock is hidden from view, on the right side of the sight 10. Also, a reticle illumination button 24 can be pushed in to cause the illuminated reticle for the reflex sight mode to light up. A side rack 26, permits the attachment of supporting devices.

Figure 2A:
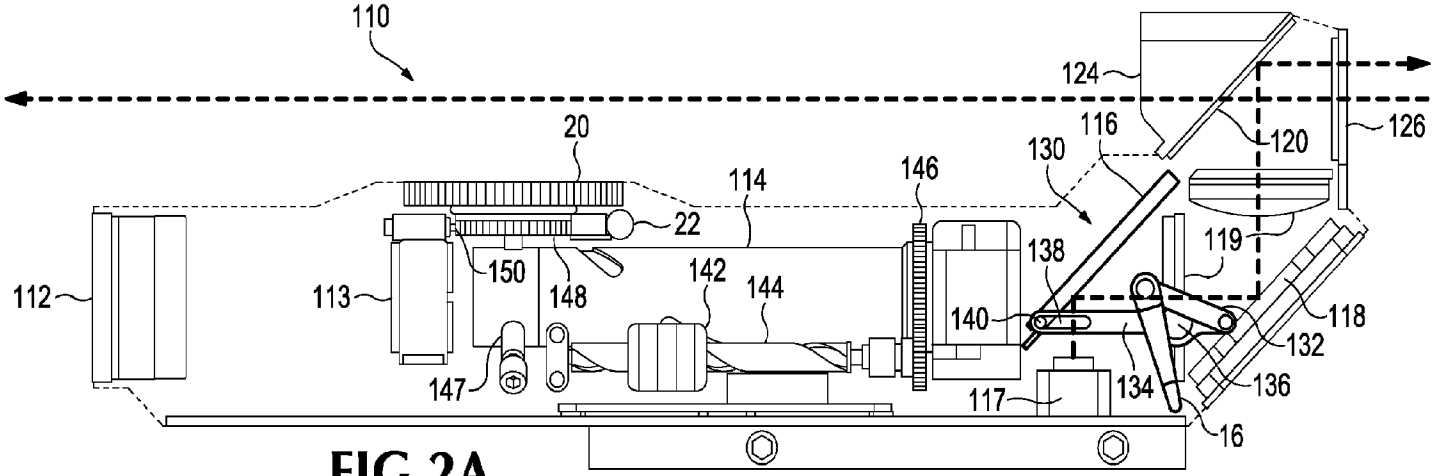
FIG. 2A is a side sectional view of the sight of FIG. 1, in reflex mode.
Figure 2B:
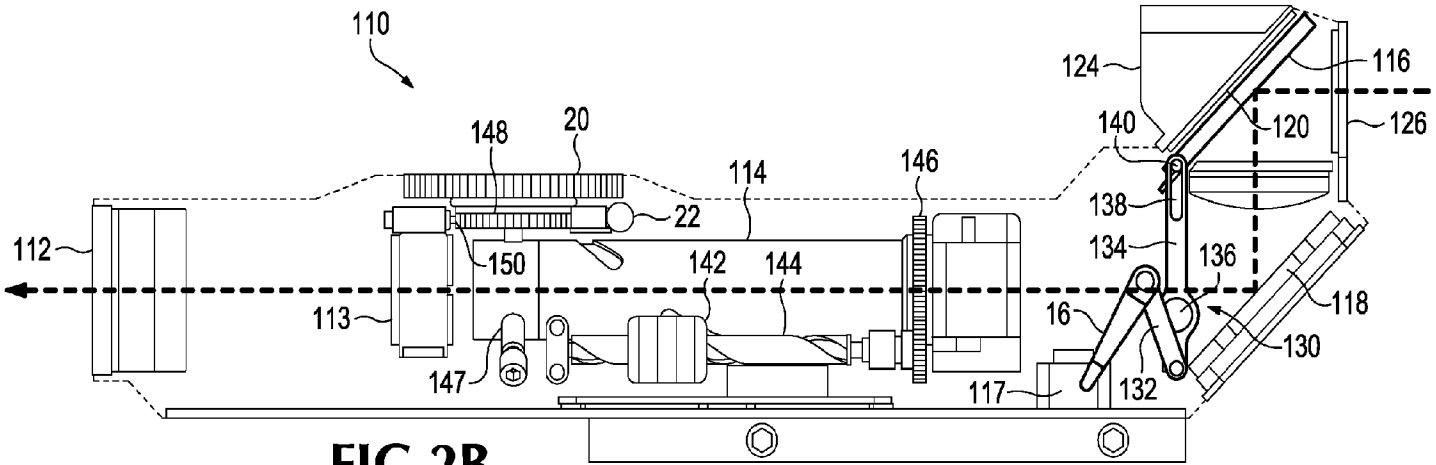
FIG. 2B is a side sectional view of the sight of FIG. 1, in telescopic mode.

Referring to FIGS. 2A and 2B, sight 10 includes an optical train 110, including a telescopic sight objective lens 112, a Petzval lens 113 (pedestal support not shown) and an erector/cam tube 114. In the reflex sight mode shown in FIG. 2A, however, the light from erector tube 114 is blocked by a moveable mirror 116, which reflects light from red luminous reticle 117 into a collimating lens set 119, with a fixed mirror 118, redirecting the light by 90° between the two lens groupings of lens set 119. A red-reflecting mirror 120, which transmits the other frequencies of light, redirects the red reticle light by 90° and combines it with light from view window 124, which passes through mirror 120. Because the light from reticle 117 passes through the collimating lens set 119, it does not need to be collimated by a dish-shaped mirror, as is the case with some prior art configurations. This permits a high quality sight design that is easily manufactured.

Referring to FIG. 2B, when the sight 10 of FIG. 1 is placed into telescopic sight mode moveable mirror 116 is moved into the position shown, where it does not block light from erector tube 114, but rather reflects this light through an image display 126. Also, mirror 116 is not in position to reflect the light from reticle 117 into the path that is reflected out of the image display 126. Collimating lens set 119 serves double duty, collimating light from the reflex reticle in reflex mode and from telescopic optical train 110 in the telescope sight mode. In telescopic sight mode a reticle appears to the viewer, created by a reticle element in the erector tube 114, in traditional configuration.

Figure 3:
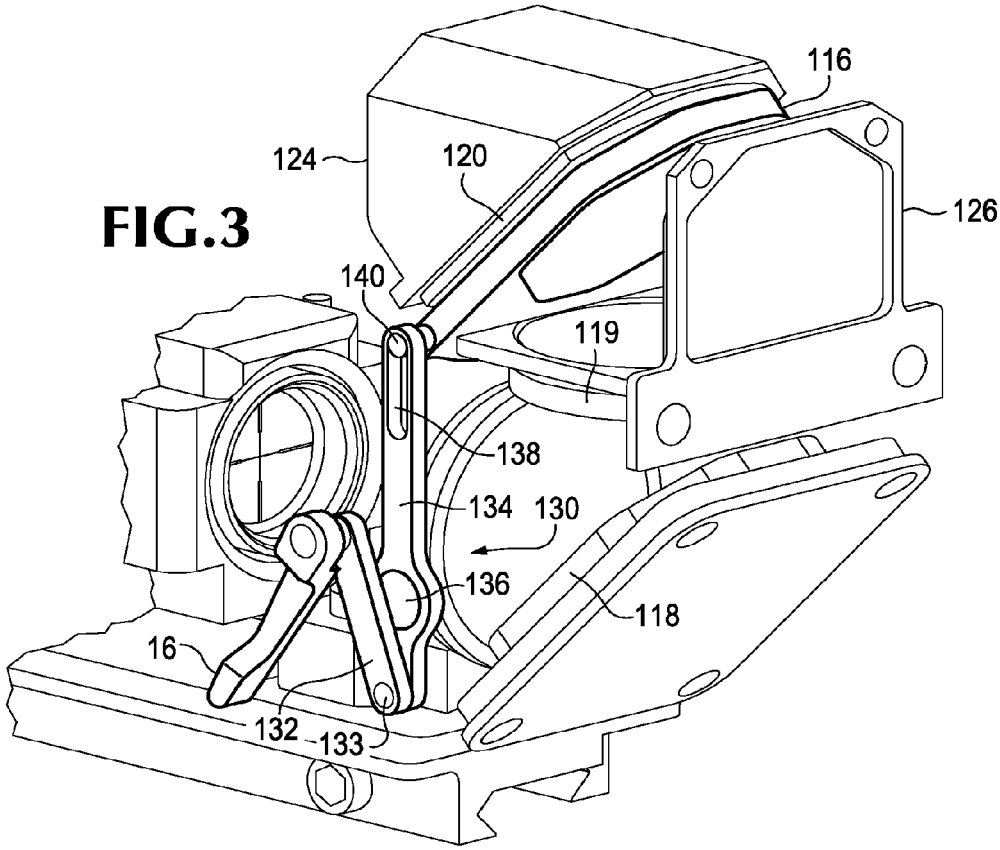
FIG. 3 is a detail perspective view of the mirror movement assembly of the dual mode sight of FIG. 1.

Referring to FIGS. 2A, 2B and 3, in one preferred embodiment dual mode sight 10 has a mirror movement assembly 130 to switch between reflex mode (FIG. 2A) and telescopic mode (FIG. 2B). User control lever 16 is rigidly attached to a hidden arm 132, which is hinged to a mirror movement lever 134 at a first hinge 133. Lever 134 is also hinged to a fixed point in sight 10, at a second hinge 136 and includes a slot 138 to allow some freedom of movement for a mirror pin 140.

Starting at the telescopic sight mode position shown in FIGS. 2B and 3, as lever 16 is moved rearward, hinge point 133 is moved upwardly, causing lever 134 to pivot about hinge 136 until hinge point 133 has risen and slot 138 has fallen, and lever 134 is in the horizontal position shown in FIG. 2A. Note that as lever 134 is moved into the horizontal position, mirror pin 140 must move inwardly in slot 138 for mirror 116 to retain its oblique orientation.

Zoom slider 18 (FIG. 1) is attached to a slider 142 (FIGS. 2A and 2B) via slider slot 19. Slider 142 rotates a pole 144 as it is moved back and forth, which in turn rotates a gear 146, which turns erector/cam tube 114, thereby changing erector lens positioning, by way of the well-known technique of cam followers in cam slots.

Elevation knob 20 is operatively connected to erector/cam tube 114 and pushes it to a further down position depending on how far knob 20 is rotated. An erector tube spring 147 resists this downward adjustment, pushing upwardly against tube 114. Windage adjust mechanism (not shown) works in the same way, and is also resisted by spring 147. A click ring 148 moves past a clicker post 150, causing a set of click sounds as knob 20 is turned, thereby informing a schooled user of the change in elevation adjustment.

Figure 4:
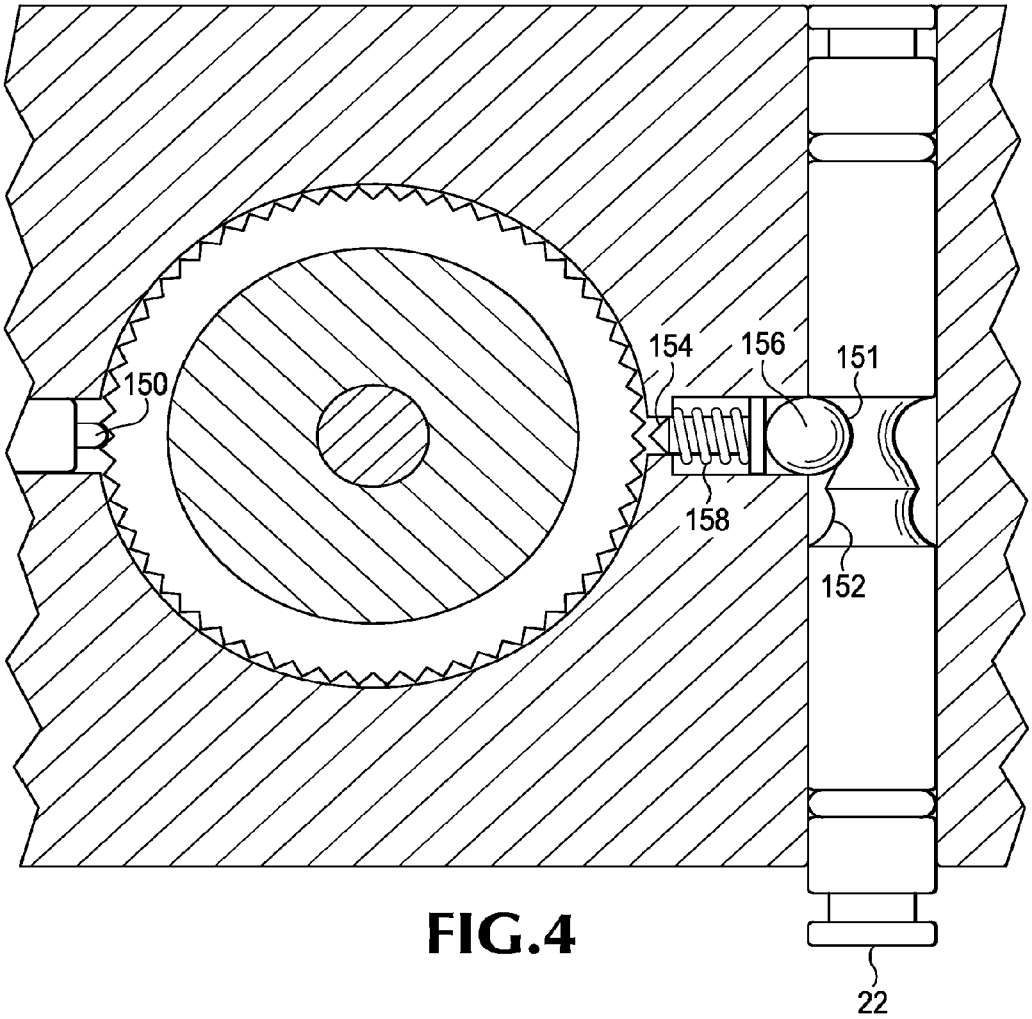
FIG. 4 is a detail perspective view taken along line 4-4 of FIG. 1.

Referring to FIG. 4, the elevation knob lock 22, noted above, is described in greater detail here. Lock 22 is actually a post that extends through sight 10, so that it always protrudes from either the left or right side of sight 10, and may always be pushed in from whatever side it is protruding. Lock post 22 defines two indents, an unlock indent 151 and a locking indent 152. When unlock indent 151 is aligned with a lock pin 154, an intermediate ball 156 can retract into indent 151, which is deep enough so that lock pin 154, which is urged into the indent by a spring 158, will not engage with the click ring 148. Locking indent 152 is so shallow, however, that ball 156 is pushed into lock pin 154, which engages with click ring 148, thereby locking the elevation knob 20.

In one preferred embodiment objective lens 112 is 32 mm in diameter, but in an alternative preferred embodiment it is rectangular and is 40 mm in width. The reflex reticle is a 60 minute of angle (MOA) diameter circle with a 1 MOA dot in the center.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A combined reflex/telescopic sight, comprising:

(a) a telescopic optical element train;

(b) a view window, offset from said optical element train;

(c) a transition assembly positioned to receive light from said optical element train and said view window, and including:

(i) an image display;

(ii) a collimating lens set positioned to transmit light to said image display;

(iii) a luminous reticle; and (iv) wherein said transition assembly is placed in a first mode wherein light from said optical element train travels through said collimating lens set to said image display and light from said view window is blocked and a second mode wherein light from said optical element train is blocked and light from said luminous reticle travels through said collimating lens set and is combined with light from said view window and a resulting combined image appears at said image display; and (d) an actuation assembly adapted to permit a user to switch said transition assembly between said first and second modes.

2. The sight of claim 1, wherein said transition assembly includes a moveable mirror that in said first mode is positioned to block light from said view window and to permit light from said optical element train to travel on a path through said collimating lens set to said image display.

3. The sight of claim 2, wherein in said second mode said moveable mirror is positioned to reflect said luminous reticle into said collimating lens set, and to block light from said optical element train from entering said collimating lens set.

4. The sight of claim 2, wherein said actuation assembly includes an actuator that is operatively connected to said moveable mirror.

5. The sight of claim 4, wherein said actuator is a lever.

6. The sight of claim 5, wherein said lever is operatively linked to an arm defining a slot and wherein said moveable mirror includes a pin that is engaged to said slot.

7. The sight of claim 1, wherein said luminous reticle emits light of a first color and said transition assembly includes a color reflecting mirror, which reflects light of said first color and transmits light of other colors and which is located coincident to said view window, and wherein, in said second mode, light from said reticle travels through said collimating lens set to said color reflecting mirror and is combined with light entering through said view window, thereby superimposing a collimated reticle on imagery from said view window.

8. The sight of claim 7, wherein said first color is red.

9. The sight of claim 2, wherein a fixed mirror is positioned to reflect light from said optical element train to said moveable mirror in its first mode position.

10. The sight of claim 9, wherein said collimating lens set includes a first lens and a second lens, oriented at a 90° angle to said first lens, and wherein said fixed mirror reflects light from said first lens to said second lens.

11. A method of switching from a reflex sight to a telescopic sight, comprising the steps of:

(a) providing a combined telescopic and reflex sight, including:

(i) a view window;

(ii) a telescopic optical train, offset from said view window;

(iii) a collimating lens set and an image display adapted to receive light from said collimating lens set;

(iv) a luminous reticle; and (v) a movable mirror placed in a first position adapted to reflect light from said luminous reticle to said collimating lens set and to block light from said telescopic optical train from entering a light path leading to said image display; and (b) moving said movable mirror from said first position to a second position where it does not reflect light from said luminous reticle but reflects light from said telescopic optical train into a path leading to said image display and blocks light from said view window.

12. The method of claim 11, wherein said combined telescopic and reflex sight further includes an actuation assembly including an actuator positioned to be manipulated by a user, and being operatively connected to said moveable mirror, and wherein said movement of said moveable mirror is done by moving said actuator.

13. The method of claim 12, wherein said actuator is a lever.

14. The method of claim 12, wherein a linkage operatively connects said actuator to said moveable mirror.

* * * * *